United States Patent [19]

Duncan

[11] 3,971,584

[45] July 27, 1976

[54] AUTOMATIC LOAD COMPENSATING CLAMP TRUCK JAWS

[75] Inventor: Alexander William Duncan, Clayton, N.C.

[73] Assignee: GTE Sylvania Incorporated, Stamford, Conn.

[22] Filed: Mar. 17, 1975

[21] Appl. No.: 558,635

[52] U.S. Cl. ..... 294/88; 214/653

[51] Int. Cl.[2] ..... B66C 1/44; B66F 9/18

[58] Field of Search ..... 294/63 R, 67 R, 67 B, 294/67 BB, 81 R, 86 R, 87 R, 87.26, 88, 99 R, 110 R, 103 CG; 214/620, 650–655, DIG. 4

[56] References Cited

UNITED STATES PATENTS

| | | | |
|---|---|---|---|
| 2,588,276 | 3/1952 | Naillon | 294/63 R |
| 2,795,346 | 6/1957 | Farmer | 214/653 |
| 2,896,994 | 7/1959 | Fischer | 214/655 X |
| 2,959,445 | 11/1960 | Breslav | 294/86 R |
| 3,199,910 | 8/1965 | Bradley | 294/86 R X |
| 3,273,931 | 9/1966 | Caldwell et al. | 294/81 R |
| 3,319,815 | 5/1967 | Vik | 214/653 X |

*Primary Examiner*—Johnny D. Cherry
*Attorney, Agent, or Firm*—Norman J. O'Malley; Thomas H. Buffton; Robert T. Orner

[57] ABSTRACT

Load engaging and gripping apparatus for attachment to the lifting mechanism of a conventional lift truck for handling loads which are crushable and yet may be compressed slightly without damage thereto. The apparatus comprises a lift assembly adapted for mounting on a lift mechanism of a lift truck with opposed carrier plates affixed to opposite ends of the lift assembly. The carrier plates on their confronting faces slidably mount load engaging and gripping platens whereby when the opposed platens are in contact with the load under light frictional engagement and the lift assembly is moved vertically upward, the platens will be moved inwardly toward each other to frictionally and firmly grip the load therebetween for lift purposes.

5 Claims, 6 Drawing Figures

AUTOMATIC LOAD COMPENSATING CLAMP TRUCK JAWS

CROSS REFERENCE TO OTHER APPLICATIONS

A concurrently filed application bearing U.S. Ser. No. 558,779 filed March 17, 1975 and entitled "Load Engaging And Gripping Apparatus" relates to apparatus for enhanced clamp truck jaw operation.

SUMMARY OF THE INVENTION

This invention relates to load engaging and gripping apparatus for attachment to the lifting and clamp actuating mechanism of a conventional lift truck said apparatus is particularly adapted for use with loads which are crushable and yet may be compressed slightly without damage to the load unit.

Many attempts have been made to provide apparatus for a lift truck which will make the clamping and lifting of crushable loads an easy and completely foolproof operation. Most of such apparatus has proven completely unsatisfactory in that it either crushes the load or does not grip it firmly enough to retain it in position during the lifting operation.

In view of the foregoing, it is an object of this invention to provide load engaging and gripping apparatus for attachment to the lifting mechanism of a conventional lift truck that will firmly grip the load for lift purposes but will not crush same.

It is another object of this invention to provide load engaging and gripping apparatus which upon light engagement with the load will automatically firmly grip the load upon upward movement of the lifting mechanism of the lift truck.

It is yet another object of this invention to provide load engaging and gripping apparatus for attachment to the lifting mechanism of a conventional lift truck which apparatus comprises a lift assembly adapted for mounting on the lifting mechanism of a lift truck with opposed carrier plates affixed to opposite ends of the lift assembly, said carrier plates on their confronting faces slidably mounting load engaging end gripping platens whereby when the opposed platens are in contact with the load under light frictional engagement and the lift assembly is moved vertically upward, the platens will be moved inwardly toward each other to frictionally and firmly grip the load therebetween for lift purposes.

IN THE DRAWINGS

FIG. 1 is a perspective view of a conventional lift truck with a preferred embodiment of the load engaging and gripping apparatus of this invention mounted thereon, FIG. 2 is an elevational view partly in section showing the load engaging platens slightly spaced from the load, FIG. 3 is a cross sectional view taken along line 3—3 of FIG. 2 illustrating the relationship of the platens to the load as in FIG. 2, FIG. 4 is an elevational view showing the platens engaging the load in compressed load lifting condition, FIG. 5 is an elevational view taken along line 5—5 of FIG. 4 illustrating the single acting hydraulic cylinder assembly and surrounding helical spring all of which form the main elements of the platen position controlling assembly, together with four bearing assemblies which control the in and out movement of the platens, and FIG. 6 is an enlarged sectional view taken along line 6—6 of FIG. 5 showing the single acting hydraulic cylinder assembly and the surrounding helical spring back of which are elements of the platen position controlling assembly.

DETAILED DESCRIPTION OF THE INVENTION

Figure 1:
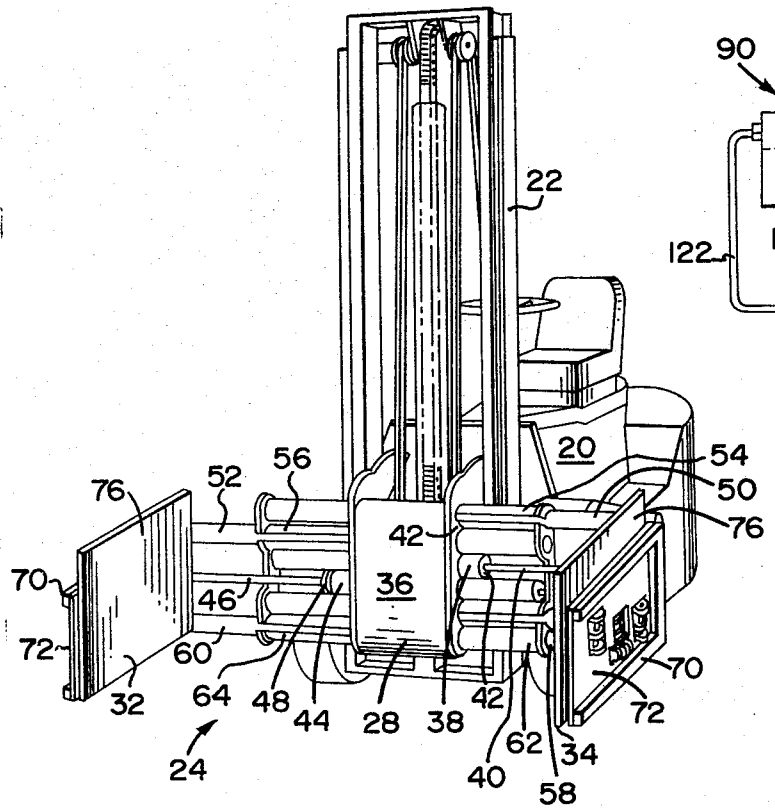

Referring to FIG. 1, there is shown a conventional lift truck 20 with a lifting mechanism 22 on which is mounted the load engaging and gripping apparatus 24 of this invention. More particularly, the load engaging and gripping apparatus 24 comprises a lift assembly 28 attached to the lifting mechanism 22 with opposed load engaging and gripping units 32 and 34 mounted on the opposite ends of the lift assembly.

The lift assembly 28 includes a housing 36 internally mounting horizontally disposed double acting hydraulic cylinder 38 having its piston rod 40 extending outwardly beyond the cylinder end 42. Similarly, housing 36 mounts double acting hydraulic cylinder 44 having its piston rod 46 extending outwardly beyond the cylinder end 48. In order to slidably support the load engaging and gripping units 32 and 34 there are provided upper guide bar housings 54 and 56 respectively and lower guide bars 58 and 60 slidably carried in guide bar housings 62 and 64 respectively.

Load engaging and gripping units 32 and 34 are identical in construction; specifically, unit 34 comprises a U-shaped carrier bracket 70 having its closed end attached to the upper and lower guide bars 50 and 58 as well as piston rod 40. A carrier plate 72 is affixed to carrier bracket 70 and movably mounts platen 76 by means of four bearing assemblies 80. (See FIG. 5). The other unit 32 is identically constructed and supported. Guide bars 52 and 60 are attached to U-shaped carrier bracket 70 as is piston rod 46. A carrier plate 72 is affixed to carrier bracket 70 and movably mounts platen 76 by means of four bearing assemblies 80 as illustrated in FIG. 5.

Figure 2:
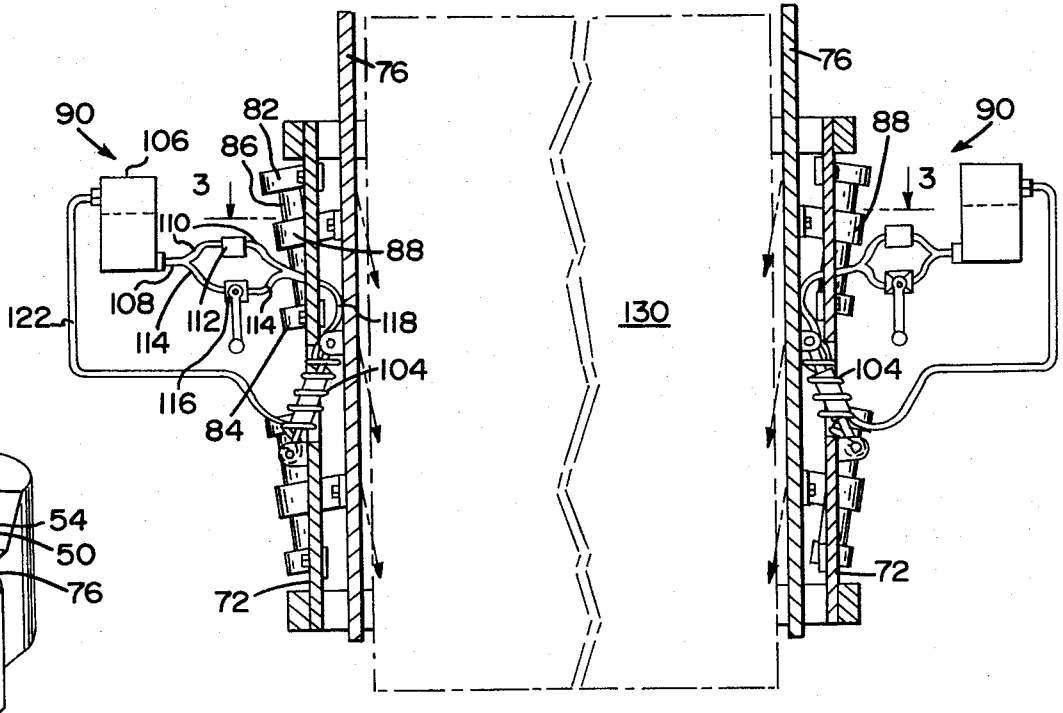
Figure 3:
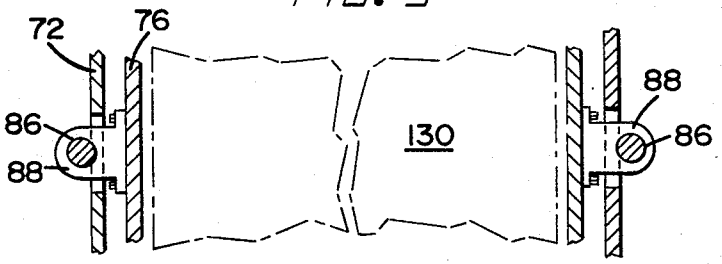
Figure 4:
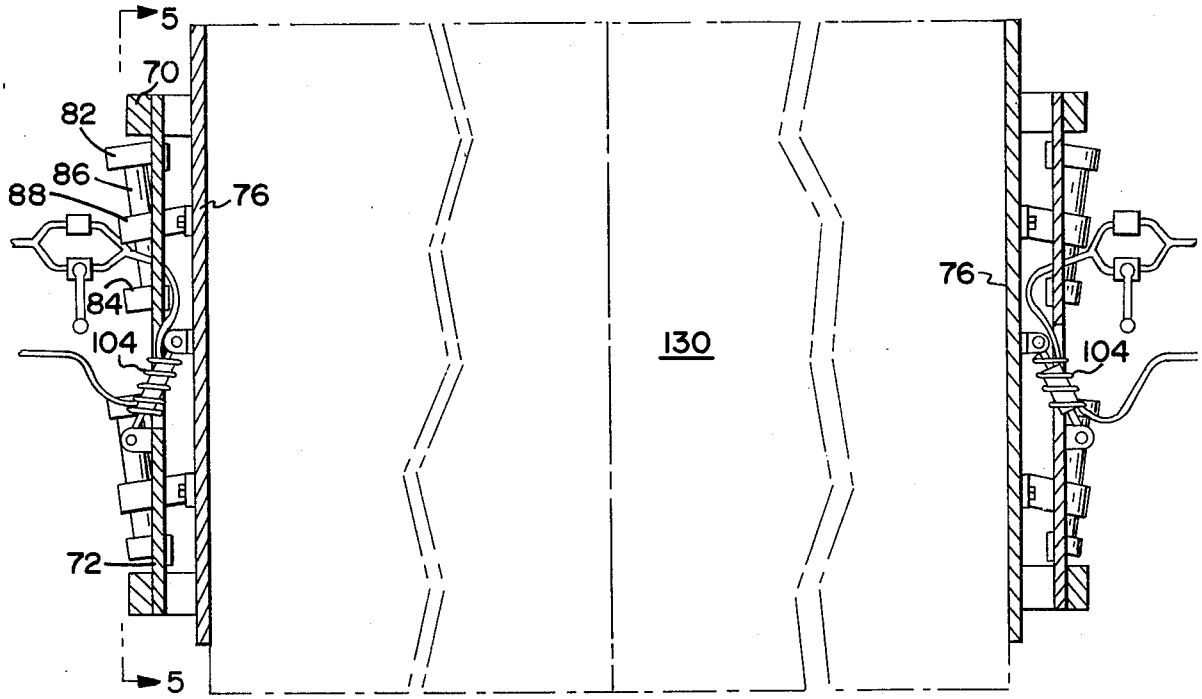
Figure 5:
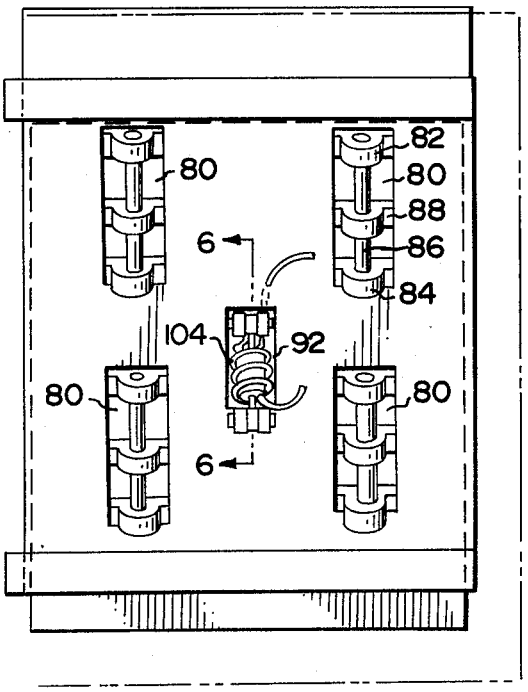

As best illustrated in FIGS. 2, 4 and 5, each bearing assembly 80 includes an upper bearing rod support 82 and a lower bearing rod support 84 secured to carrier plate 72 and angularly mounting a bearing rod 86. Bearing 88 is slidably carried on bearing rod 86 and is secured to platen 76. It will thus be apparent that platen 76 is movably mounted on carrier plate 72 by means of the four bearing assemblies 80. It should be noted that all bearing rods 86 are angled downwardly and inwardly and that each bearing rod is given the exact same slope. It necessarily follows that downward movement of the confronting platens 76—76 relative to their carrier plates 72—72 will result in the narrowing of the distance between said platens. The length of the bearing rods 86 and their angular disposition control the movement of the platens 76 with respect to the carrier plates 72. In other words, the vertical reciprocation of the platens is controlled by the length of the bearing rods 86 while the horizontal travel is controlled by the angular position of the bearing supports.

Figure 6:
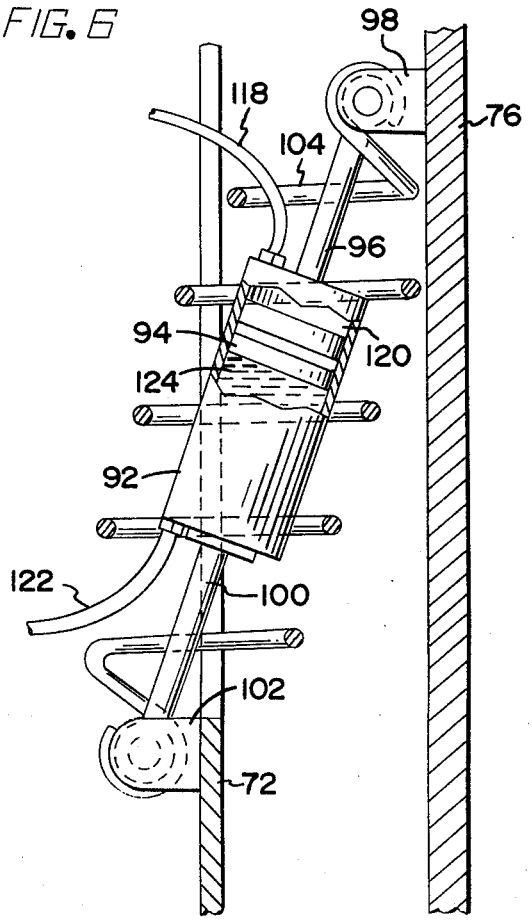

In order to control the position of each platen 76 with respect to its carrier plate 72 a platen position control assembly 90 is provided therefor. Referring to FIGS. 2, 4 and 6, assembly 90 comprises a hydraulic cylinder 92 having a piston 94 with an outwardly extending piston rod 96 connected to platen 76 by means of bracket assembly 98. The lower end of the hydraulic cylinder 92 is closed and has an arm 100 extending therefrom and connected to carrier plate 72 by bracket assembly 102. A helical spring 104 fits over the hydraulic cylinder 92 and is attached to platen 76 by bracket assembly 98 and to carrier plate 72 by bracket assembly 102.

Referring to FIG. 2, the platen position control assembly 90 also includes a hydraulic liquid reservoir 106 having an opening at its lower side portion converted to a feed and return conduit 108 terminating in a Y connection having connected thereto a feed conduit 110 provided with a check valve 112 allowing flow away from the reservoir 106. The other side of the Y is connected to a return line 114 provided with a two-way manually adjustable valve 116. Feed conduit 110 and return line 114 merge into a line 118 connected to the upper chamber 120 of the hydraulic cylinder 92. A vent line 122 connects the lower hydraulic cylinder chamber 124 to the top portion of the reservoir 106. The liquid level in the reservoir 106 is indicated by the dotted line approximately two-thirds up from the reservoir bottom. As is obvious from the drawings, a platen position control assembly 90 is provided for both of the load engaging and gripping units 32 and 34.

With regard to the use of load engaging and gripping apparatus of this invention reference is made particularly to FIGS. 2 and 4. Specifically, FIG. 2 shows the apparatus in what might be termed the at rest or no load position wherein the helical springs 104 have forced the platens 76—76 upwardly with respect to their carrier plates 72—72 whereby the bearings 88 are positioned well up on their respective bearing rods 86. In this position the platens 76 are spaced apart their maximum distance. With the apparatus in the position illustrated in FIG. 2 the truck operator maneuvers his truck so that the platens 76 are in line with opposite sides of the package 130, shown in dotted lines. The operator next actuates double acting hydraulic cylinder assemblies 38 and 44 to cause the carrier plates 72 and respective platens 76 to move inwardly toward each other until the platens 76 engage the adjacent package sides with sufficient force to preload the package and establish frictional contact between each platen and its respective package side. At this stage the hydraulic cylinder assemblies 38 and 44 are locked and serve to retain the carrier plates 72 and associated platens 76 in such position. After this the operator actuates the lifting mechanism *22* to raise the lift assembly 28 thus causing the carriers 72—72 to move upwardly whereby the platens 76 will move further inwardly to produce sufficient friction so that the platens 76 will firmly grip the package and cause it to be lifted as the carriers 72 continue their upward travel.

Referring to FIG. 6, as the carrier plate 72 rises, helical spring 104 is compressed to provide a stored energy source to cause the platen 76 to return to its at rest position upon release from the package. Simultaneously with the compression of the helical spring 104, piston 94 is accordingly forced downwardly in the hydraulic cylinder 92 thus drawing hydraulic liquid from the reservoir 106 through conduit 108, feed line 110, one-way check valve 112, feed line 110 and line 118 into cylinder upper chamber 120.

Since the one-way check valve 112 allows flow only from the reservoir 106 and further since valve 116 is closed the liquid introduced in the upper chamber 120 serves to lock the platens 76 in position until the liquid is allowed to flow from the upper chamber 120 by the opening of valve 116 thereby allowing return flow to the reservoir 106. It is thus apparent that the platens 76 are held in their engaged position by the hydraulic cylinders 92 to assure that proper contact is maintained at all times between the platens and the package. When the package has been delivered to the designated place, valve 116 is slowly opened allowing hydraulic liquid in upper chamber 120 to return to the reservoir 106 whereupon compressed helical spring 104 expands and in the course of raising the platens 76 also causes them to be drawn away from the package due to the slope of the bearing rods 86 and thus ready for reuse.

In view of the foregoing, it should be clear that the load engaging and gripping apparatus of this invention makes it possible to engage and lift crushable packages by their opposing sides with substantial assurance that the package will not be damaged and that the load will not be dropped.

What I claim is:

1. Load engaging and gripping apparatus for attachment to the lifting mechanism of a lift truck for handling loads, said apparatus comprising:

a lift assembly adapted for mounting on the lift mechanism of a lift truck;

opposed load engaging and gripping means including opposed load engaging and gripping platens; and means for connecting said opposed load engaging and gripping means to said lift assembly, said means including a carrier plate connected to opposite ends of said lift assembly and a slide bearing means cooperatively mounted on said carrier plate and each one of said opposing load engaging and gripping platens, said slide bearing means including a plurality of bearing assemblies each with an angularly disposed bearing rod and a bearing slidably carried thereon whereby said opposed load engaging and gripping means are in light frictional contact with a load under at rest conditions and move inwardly toward one another to firmly grip the load therebetween when the lift assembly is moved vertically upward.

2. The invention as set forth in claim 1 including means for maintaining the opposed platens in firm engagement with the load comprising a hydraulic cylinder and piston assembly including means for feeding hydraulic liquid to the cylinder connecting a carrier plate and its respective platen whereby when there is movement of the platen relative to the carrier plate hydraulic liquid is drawn into the hydraulic cylinder to retain the piston in position and thus retain the relative position of the carrier plate and platen.

3. The invention as set forth in claim 2 and wherein means are provided for returning the platens to their upper no load position upon release of the load.

4. The invention as set forth in claim 3 and wherein the means for returning the platens to their upper no load position comprises a spring positioned between each carrier plate and its platen, said spring storing energy upon relative movement of the platen and carrier plate for return of platen to the no load position upon release of the load.

5. The invention as set forth in claim 2 and wherein the means for feeding hydraulic liquid to the cylinder comprises a liquid reservoir, a feed conduit connecting the reservoir to the cylinder, a check valve in the feed conduit allowing flow only from the reservoir to the cylinder, a return line connecting the reservoir to the cylinder and a manually operated valve in said return line for controlling flow from the cylinder to the reservoir.

* * * * *